US006892872B2

(12) United States Patent
Miyashita

(10) Patent No.: US 6,892,872 B2
(45) Date of Patent: May 17, 2005

(54) SHEET PROCESSING APPARATUS

(75) Inventor: Morimasa Miyashita, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 158 days.

(21) Appl. No.: 10/347,280

(22) Filed: Jan. 21, 2003

(65) Prior Publication Data

US 2003/0136630 A1 Jul. 24, 2003

(30) Foreign Application Priority Data

Jan. 22, 2002 (JP) ..... P2002-013437

(51) Int. Cl.[7] ..... B65H 39/00; G07D 7/00
(52) U.S. Cl. ..... 194/302; 271/298
(58) Field of Search ..... 194/302, 206–217; 270/58.08, 58.09, 58.11, 52.01, 52.03, 58.33, 58.34; 209/534; 271/298, 176, 3.14, 3.15, 3.17, 256, 258.01, 259, 258.02, 65

(56) References Cited

U.S. PATENT DOCUMENTS

| | | | | | |
|---|---|---|---|---|---|
| 3,412,993 | A | | 11/1968 | Glori | 270/1 |
| 3,710,936 | A | | 1/1973 | Mizunuma | 209/82 |
| 3,759,382 | A | | 9/1973 | Walkley et al. | 209/111.7 |
| 3,938,663 | A | | 2/1976 | Carnes et al. | 209/73 |
| 4,025,420 | A | | 5/1977 | Horino | 209/74 R |
| 4,045,944 | A | | 9/1977 | Giori | 53/123 |
| 4,236,639 | A | | 12/1980 | Boettge et al. | 209/534 |
| 4,365,700 | A | * | 12/1982 | Arimoto et al. | 194/206 |
| 4,402,410 | A | | 9/1983 | Ohba et al. | 209/534 |
| 4,418,417 | A | | 11/1983 | Uchida et al. | 377/8 |
| 4,458,816 | A | | 7/1984 | Horino et al. | 209/548 |
| 4,747,492 | A | * | 5/1988 | Saito et al. | 209/534 |
| 4,825,378 | A | * | 4/1989 | Yuge | 700/223 |
| 5,000,322 | A | * | 3/1991 | Goi | 209/534 |
| 5,106,076 | A | * | 4/1992 | Fujita et al. | 271/287 |
| 5,227,816 | A | * | 7/1993 | Forest | 347/153 |
| 5,247,159 | A | * | 9/1993 | Yuge et al. | 235/379 |
| 5,522,511 | A | * | 6/1996 | Sakoguchi et al. | 209/534 |
| 5,541,393 | A | * | 7/1996 | Ikezawa et al. | 235/98 R |

FOREIGN PATENT DOCUMENTS

| | | |
|---|---|---|
| EP | 0 264 125 | 4/1988 |
| EP | 0 302 458 A2 | 2/1989 |
| EP | 0 335 631 A2 | 10/1989 |
| GB | 793696 | 4/1958 |
| WO | WO 00/57367 | 9/2000 |
| WO | WO 01/52196 A1 | 7/2001 |

OTHER PUBLICATIONS

European Search Report dated Sep. 21, 2004 for Patent Application No. 03250295.7.

* cited by examiner

*Primary Examiner*—Donald P. Walsh
*Assistant Examiner*—Mark J. Beauchaine
(74) *Attorney, Agent, or Firm*—Pillsbury Winthrop LLP

(57) ABSTRACT

The banknote processing apparatus has a receiving portion into which banknotes are inserted, a take-out roller for taking out banknotes from the receiving portion, a detector for discriminating "regular and defective" and "front and back" of taken-out banknotes, and first to fourth stacking and banding devices for classifying and stacking banknotes on the basis of discrimination results and banding each 100 banknotes. When the first stacking and banding device fails in a mode that the first and second stacking and banding devices stack front bills and the third and fourth stacking and banding devices stack back bills, in expectation of 100 front bills being stacked in the second stacking and banding device, in the timing that the 97th front bill passes the detector, the take-out roller is stopped. When the number of front bills is less than 100, the take-out roller rotates and takes out one banknote.

11 Claims, 9 Drawing Sheets

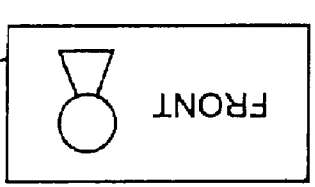
FRONT REVERSE
FIG. 4B
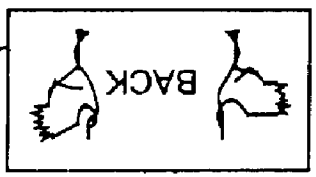
BACK REVERSE
FIG. 4D
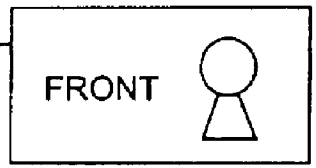
FRONT REGULAR
FIG. 4A
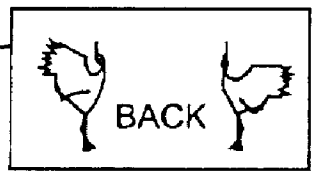
BACK REGULAR
FIG. 4C
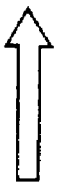
CONVEYING DIRECTION

SHEET PROCESSING APPARATUS

BACKGROUND OF THE INVENTION

1. Field of the Invention

The present invention relates to a sheet processing apparatus for discriminating a plurality of sheets, classifying them into categories such as kind, front and back, top and bottom, and staining state, and stacking the classified sheets respectively in a predetermined number.

2. Description of the Related Art

Conventionally, as a sheet processing apparatus, a banknote processing apparatus for inserting a plurality of banknotes into the receiving portion, taking out the inserted banknotes from the take-out portion onto the conveying path one by one, discriminating the banknotes conveyed on the conveying path by the detector, stacking regular bills discriminated as reusable banknotes by the detector in the stacker, moving-a predetermined number (for example, 100) of regular bills from the stacker to the banding unit, and banding them is known.

Among this kind of banknote processing apparatuses, for example, a type of apparatus having only one set of stacker and banding unit, at the point of time when the 100th regular bill judged as reusable by the detector passes the detector, stops the banknote take-out operation by the take-out portion once. And, the apparatus moves the 100 regular bills stacked in the stacker to the banding unit and bands them with a paper band. Furthermore, after moving the 100 regular bills from the stacker to the banding unit, the apparatus restarts the banknote take-out operation by the take-out portion.

At this time, regular bills after the 100th bill taken out on the conveying path from the take-out portion to the detector at the point of time when the banknote take-out operation is stopped are ejected into the reject box without being stacked in the stacker. And, after all the banknotes are taken out, the rejected regular bills are inserted into the receiving portion again by the hand operation of an operator. In this case, the operation of reinsertion of the rejected regular bills into the receiving portion by the hand operation requires a great deal of time and is troublesome.

Therefore, as indicated in U.S. patent application Ser. No. 09/978,670, there is such a type of apparatus available as to install 2 sets of stackers for stacking regular bills and banding units for banding stacked regular bills and to alternately stack and band 100 regular bills. However, also in this type of apparatus, when the stacker (or banding unit) of one set is broken down or the paper bands of the banding unit of one set are all gone, only the stacker and banding unit of one set can be used and the same problem as the aforementioned arises.

SUMMARY OF THE INVENTION

An object of the present invention is to provide a sheet processing apparatus capable of lightening the operation burden imposed on an operator and improving the operation rate.

According to the present invention, a sheet processing apparatus is provided. The apparatus comprises a receiving portion to receive a plurality of sheets to be inserted; a take-out portion to take out sheets inserted into the receiving portion one by one on a conveying path; a detector to detect characteristics of the sheets taken out on the conveying path by the take-out portion and discriminate a category thereof; a stacking portion to stack a predetermined number M of sheets discriminated as a specific category by the detector; and a controller to control the take-out portion so as to stop an operation of the take-out portion at the point of time when an Nth sheet less than the predetermined number M to be stacked in the stacking portion is discriminated.

BRIEF DESCRIPTION OF THE DRAWINGS

FIG. 4 is a drawing for explaining the conveying posture of a banknote conveyed in the processing apparatus shown in FIG. 1.

DETAILED DESCRIPTION OF THE PREFERRED EMBODIMENTS

The embodiment of the present invention will be explained in detail hereunder with reference to the accompanying drawings.

Figure 1:
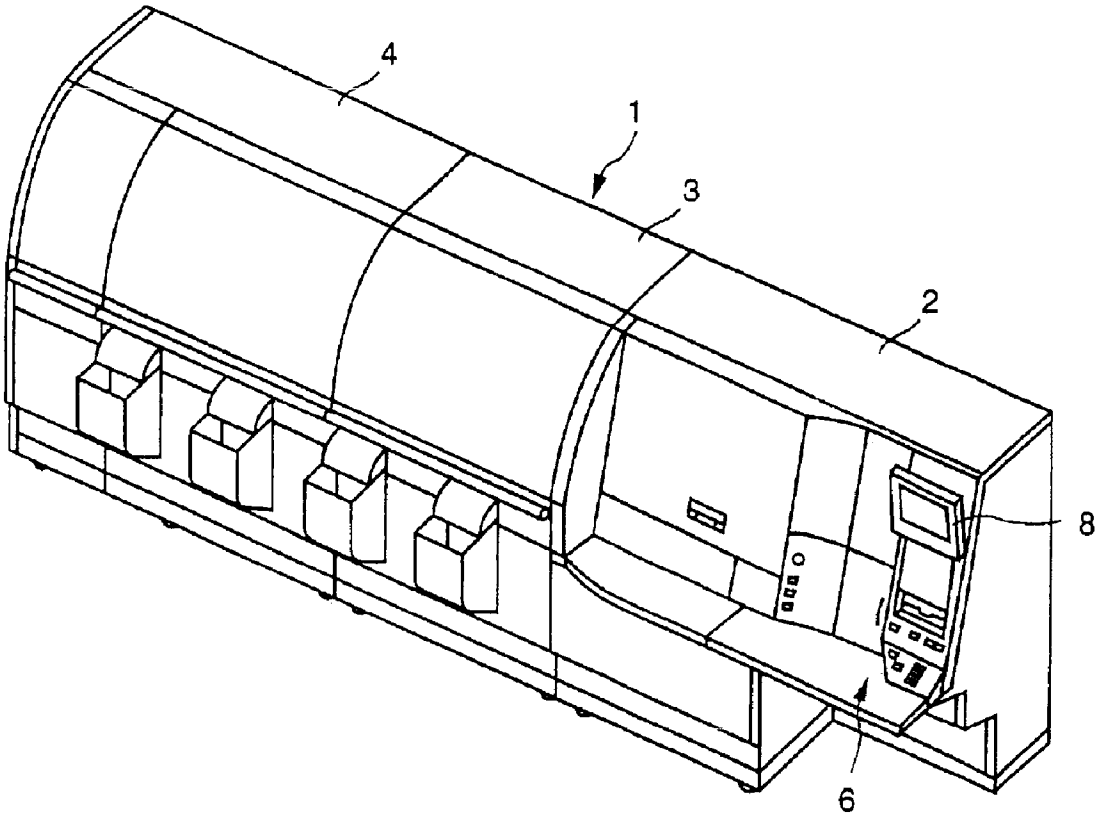
FIG. 1 is a perspective view showing the appearance of a banknote processing apparatus relating to the embodiment of the present invention.
Figure 2:
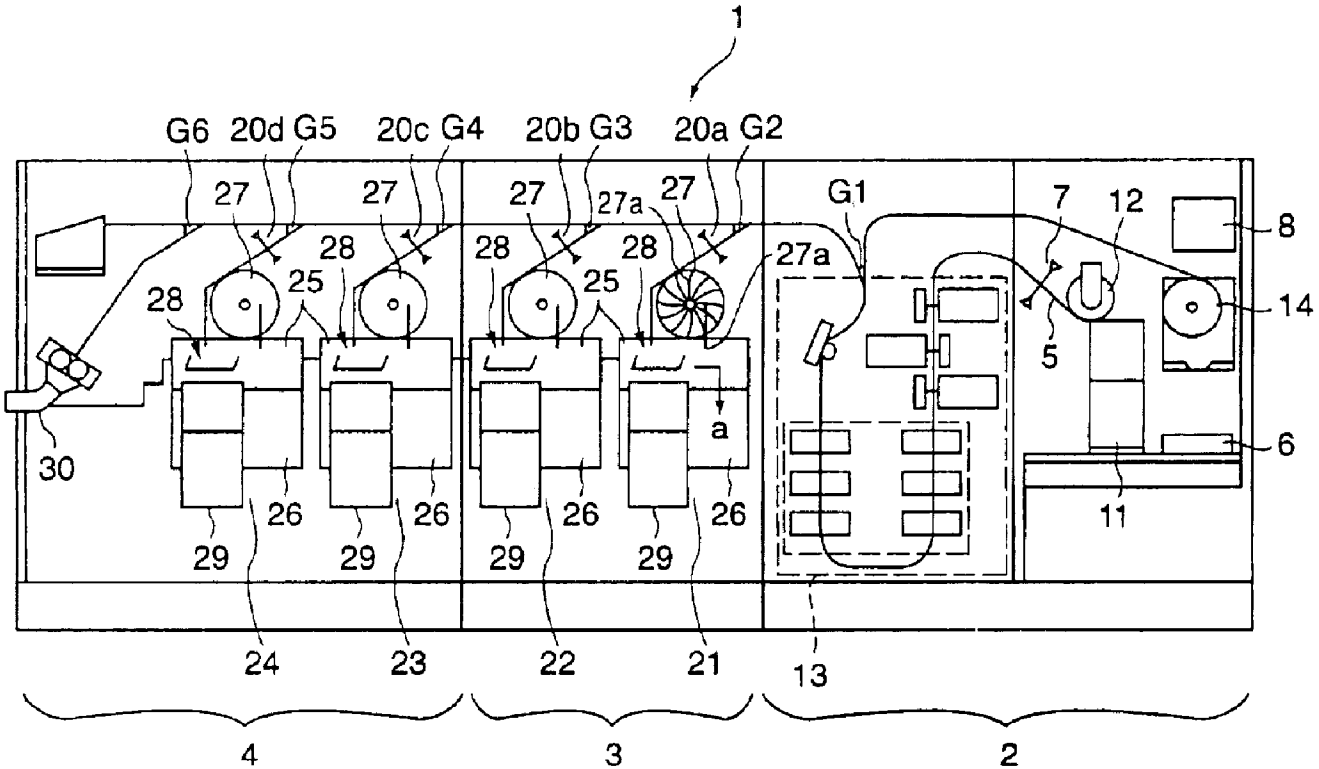
FIG. 2 is a schematic view showing the internal structure of the processing apparatus shown in FIG. 1.

FIG. 1 shows a perspective view of the appearance of a banknote processing apparatus 1 (hereinafter, referred to as just a processing apparatus 1) as a sheet processing apparatus relating to the embodiment of the present invention. Further, FIG. 2 schematically shows the internal structure of the processing apparatus 1.

The processing apparatus 1, from the right of the processing apparatus, has a supply/discrimination unit 2 for supplying and discriminating banknotes, a stacker and banding unit 3 for classifying and stacking discriminated banknotes for each category according to the discrimination results thereof and banding banknotes stacked in each stacker for each predetermined number (100 bills in this embodiment), and a stacker and banding/shredder unit 4 having a function for stacking and banding discriminated banknotes for each category and a function for shredding banknotes to lose validity and is structured so as to connect the three unit 2, 3, and 4.

Depending on the operation, an apparatus not having the stacker and banding unit 3 in the center may be used.

Figure 3:
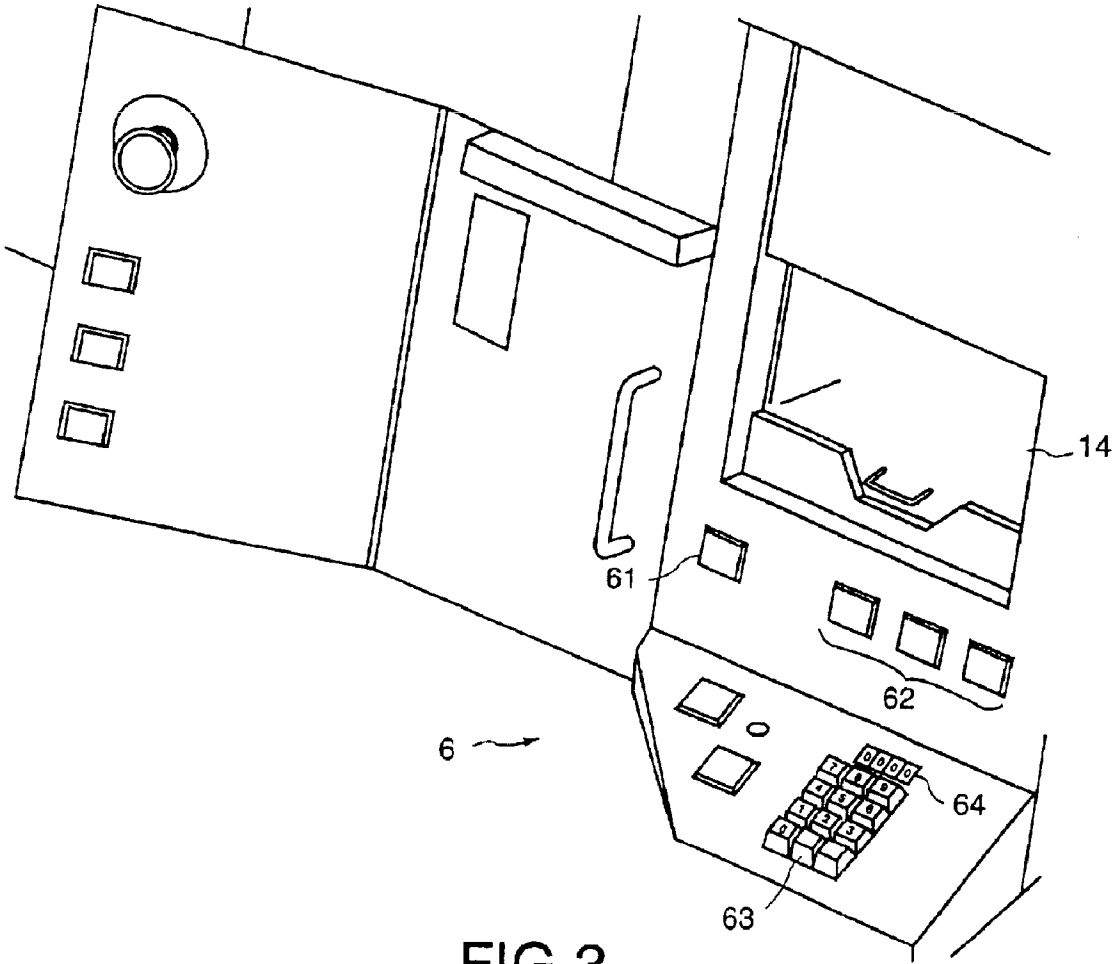
FIG. 3 is a partially enlarged view showing an enlarged part of the processing apparatus shown in FIG. 1.

On the front of the supply/discrimination unit 2 on the uppermost stream side, an operation panel 6 for receiving input of various operations by an operator and a display for displaying guidance of various operations for the operator are installed. On the operation panel 3, as partially enlarged in FIG. 3, a supply start button 61 for instructing supply start of banknotes, a mode switching button 62 for switching the operation mode of the processing apparatus 1, a ten-key 63 for inputting numerals, and a counter display 64 for displaying the number of banknotes to be processed are installed.

As shown in FIG. 2, the supply/discrimination unit 2 has a receiving portion 11 into which a plurality of banknotes to be processed are inserted in a stacked state, a take-out roller 12 for taking out inserted banknotes one by one onto a conveying path 5 starting from the uppermost banknote, a detector 13 for detecting characteristics of banknotes taken out on the conveying path 5 and discriminating categories of banknotes such as money kind, regular and defective, direction concerning front and back, top and bottom, and true and false, and a reject box 14 for stacking removable bills discriminated as banknotes to lose validity by the detector 13.

The stacker and banding unit 3 have two stacking and banding devices 21 and 22 installed in parallel along the conveying path 5. The respective stacking and banding devices 21 and 22 have stackers 25 for classifying and stacking regular bills discriminated as regular banknotes reusable by the detector 13 on the basis of the discrimination results by the detector 13 and banking units 26 for banding regular bills stacked in the stackers 25 with a paper band for each 100 bills.

Each of the stackers 25 has an impeller 27 having a plurality of shuttlecocks 27*a* extending radially and a stacker 28 for stacking regular bills introduced via the impeller 27 and also moving in the direction of the arrow a shown in the drawing and transferring 100 regular bills stacked to the banding unit 26. The stacker 28 receives regular bills in a predetermined stacking position, moves to the banding unit 26 along the arrow a shown in the drawing in a state of stacking 100 regular bills, transfers stacked regular bills to the banding unit 26, then moves in the opposite direction, and returns to the original stacking position. The banding unit 26 supplies a paper band and bands the 100 regular bills stacked in the stacker 28 and stores a bundle of banded regular bills in a storage unit 29.

The stacker and banding/shredder unit 4 on the downmost stream side has two stacking and banding devices 23 and 24 having the same structure as that of the stacking and banding devices 21 and 22 and also has a shredder 30 for cutting and storing banknotes to lose validity (defective bills).

Next, an operation example of the processing apparatus 1 structured as mentioned above will be explained. Here, an operation to assign the two stacking and banding devices 21 and 22 installed in the stacker and banding unit 3 on this side to front bills, assign the two stacking and banding devices 23 and 24 installed in the stacker and banding/shredder unit 4 to back bills, and alternately stack and band each 100 regular bills in the respective two stacker and banding units (four units in total) assigned for each kind of banknotes, that is, each category (front and back) will be explained.

As shown in FIG. 4, banknotes are conveyed on the conveying path 5 in the direction of the short side and there are four directions concerning the "front and back" and "top and bottom". Namely, there are banknotes to be conveyed with the front up and the upper end ahead (hereinafter referred to as front regular bills) as shown in FIG. 4A, banknotes to be conveyed with the front up and the lower end ahead (hereinafter referred to as front reverse bills) as shown in FIG. 4B, banknotes to be conveyed with the back up and the upper end ahead (hereinafter referred to as back regular bills) as shown in FIG. 4C, and banknotes to be conveyed with the back up and the lower end ahead (hereinafter referred to as back reverse bills) as shown in FIG. 4D. Namely, in this embodiment, front regular bills and front reverse bills are front bills of the same category, that is, the same money kind to be alternately classified and stacked for each 100 bills in the stacking and banding devices 21 and 22 and back regular bills and back reverse bills are back bills of the same category, that is, the same money kind to be alternately classified and stacked for each 100 bills in the stacking and banding devices 23 and 24.

Further, "regular bill" referred to as here means a banknote which is recognized as a regular and valid banknote by discrimination and used again. "Defective bill" means a banknote which is recognized as a regular and valid banknote by discrimination, but is not suited to reuse, thereby is to be shredded and lose validity by the shredder 30. "False bill" means a banknote which is recognized as an irregular and invalid banknote by discrimination (a banknote which cannot be decided is recognized as invalid). "Undiscriminating bill" means a banknote which cannot be discriminated for the reason of, for example, double feed, skewing (skewing of a banknote), or a short pitch (in the conveying path, the interval between two continuous banknotes is excessively narrow, thus the processing on the later stage is difficult). "Removable bill" to be removed to the reject box 14 means a banknote in combination of "false bill" and "undiscriminating bill" mentioned above.

Prior to the operation, firstly, an operator loosens the union of banknotes banded for each 100 bills and inserts a plurality of banknotes to be processed into the receiving portion 11. Generally, 1000 banknotes are inserted into the receiving portion 11 in a batch for each processing. Here, banknotes to be inserted are in a varied state of the directions concerning "front and back" and "top and bottom".

Hereafter, when the operator presses the supply start button 61 of the operation panel 6, banknotes are clung one by one by sucking force of a pump not shown in the drawing by the take-out roller 12 and taken out on the conveying path 5. Banknotes taken out on the conveying path 5 are detected by a sensor 7 installed immediately behind the take-out roller 12 and the number of banknotes taken out is counted. The number of taken-out banknotes is displayed on the counter display 64 of the operation panel 6. Banknotes taken out on the conveying path 5 are conveyed on the conveying path 5 and pass the detector 13 and here, the characteristics of the banknotes are detected and the money kind of the banknotes, truth and falsehood, the directions concerning "front and back" and "top and bottom", and regular and defective are discriminated. Therefore, the classification destination of banknotes is judged immediately after passing the detector 13.

Banknotes among the banknotes passing the detector 13 which are discriminated as removable bills are stacked in the reject box 14 via the gate G1. Further, defective bills passing the detector 13 pass all the gates G1 to G6, are sent to and shred by the shredder 30, and lose validity. Furthermore, regular bills passing the detector 13 pass the gate G1 and then are stacked in the predetermined stacking portion 25 via the gates G2 to G5 which are selectively switched on the basis of the discrimination results.

In this embodiment, front bills are alternatively stacked in the stackers 25 of the stacking and banding devices 21 and 22 for each 100 bills and back bills are alternatively stacked in the stackers 25 of the stacking and banding devices 23 and 24 for each 100 bills. Further, regular bills stacked in the respective stackers 25 are detected by stacking counters 20*a*, 20*b*, 20*c*, and 20*d* installed immediately behind the gates G2 to G5 and the numbers of stacked regular bills in the respective stackers 25 are counted.

For example, regular bills which pass the detector 13 and are discriminated as front bills are firstly stacked sequentially in the stacking portion 25 of the stacking and banding device 21 on the right in the stacker and banding unit 3 in the center. At this time, front bills, after passing the gate G2, are counted by the stacking counter 20*a*, enter the gap of the shuttlecock 27*a* installed on the impeller 27, strike against a scrape plate 27*b*, come off the impeller 27, and are stacked on the stacker 28. And, when the number of front bills stacked in the stacker 28 like this reaches 100, the stacker 28 in the state of stacking front bills moves in the direction of the arrow a shown in the drawing and 100 front bills are transferred to the banding unit 26. When receiving the 100 front bills, the banding unit 26 supplies a predetermined paper band to the 100 front bills and bands them. The bundle of banded regular bills is stored in the storage unit 29. Further, the stacker 28 transferring the banknotes to the banding unit 26 moves in the opposite direction and returns to a predetermined stacking position.

In this case, the stacking portion 25, before the stacker 28 moving to the banding unit 26 returns to the predetermined stacking position (the position shown in the drawing), cannot stack banknotes. Namely, when banknotes come to the stacking portion 25 when the stacker 28 is not in the stacking position shown in the drawing, there is no unit for stacking the banknotes available, so that the banknotes may be scattered.

Then, at the point of time when the 100th front bill passes the stacking counter 20*a*, the gates G2 and G3 are switched respectively in a predetermined direction, thus front bills after the 100th bill are not conveyed to the stacking portion 25 of the stacking and banding device 21 on the right but stacked in the stacking portion 25 of the stacking and banding device 22 on the left. Also in the stacking portion 25 on the left, when 100 front bills are stacked in the stacker 28 in the same way, the stacker 28 moves down to the banding unit 26 and transfers the 100 front bills to the banding unit 26. In other words, the two stacking and banding devices 21 and 22 stack and band alternatively 100 front bills, thus the processing apparatus 1 can process continuously without stopping. Further, needless to say, back bills are also processed by alternatively operating the two stacking and banding devices 23 and 24.

As shown by the above explanation, in the processing apparatus 1 having the four stacking and banding devices "21 and 22" and "23 and 24" as mentioned above, when two devices are assigned and used for each kind of banknotes to be classified and stacked (front and back in this embodiment), the processing apparatus 1 can be operated continuously and the stacking and classifying process of banknotes can be executed smoothly.

However, when one banding unit cannot be used, for example, because paper bands are all gone in the banding unit 26 which is one of the four stacking and banding devices during the aforementioned processing or one of the four stacking and banding devices fails, the aforementioned continuous processing cannot be performed. For example, when one side of the stacking and banding device 21 for classifying and stacking front bills fails, only the other side of the stacking and banding device 22 must process all front bills. Therefore, after stacking 100 front bills in the stacker 28 of the stacking and banding device 22, until the stacker 28 transfers the front bills to the banding unit 26 and returns to the predetermined stacking position, the processing apparatus 1 must be stopped temporarily. When the processing apparatus 1 is stopped like this, not only the operation rate of the apparatus is reduced but also banknotes already taken out and left on the conveying path must be removed into the reject box 14 once after stop and a problem arises that to re-supply the removed banknotes, the operation burden imposed on an operator is increased.

Figure 5:
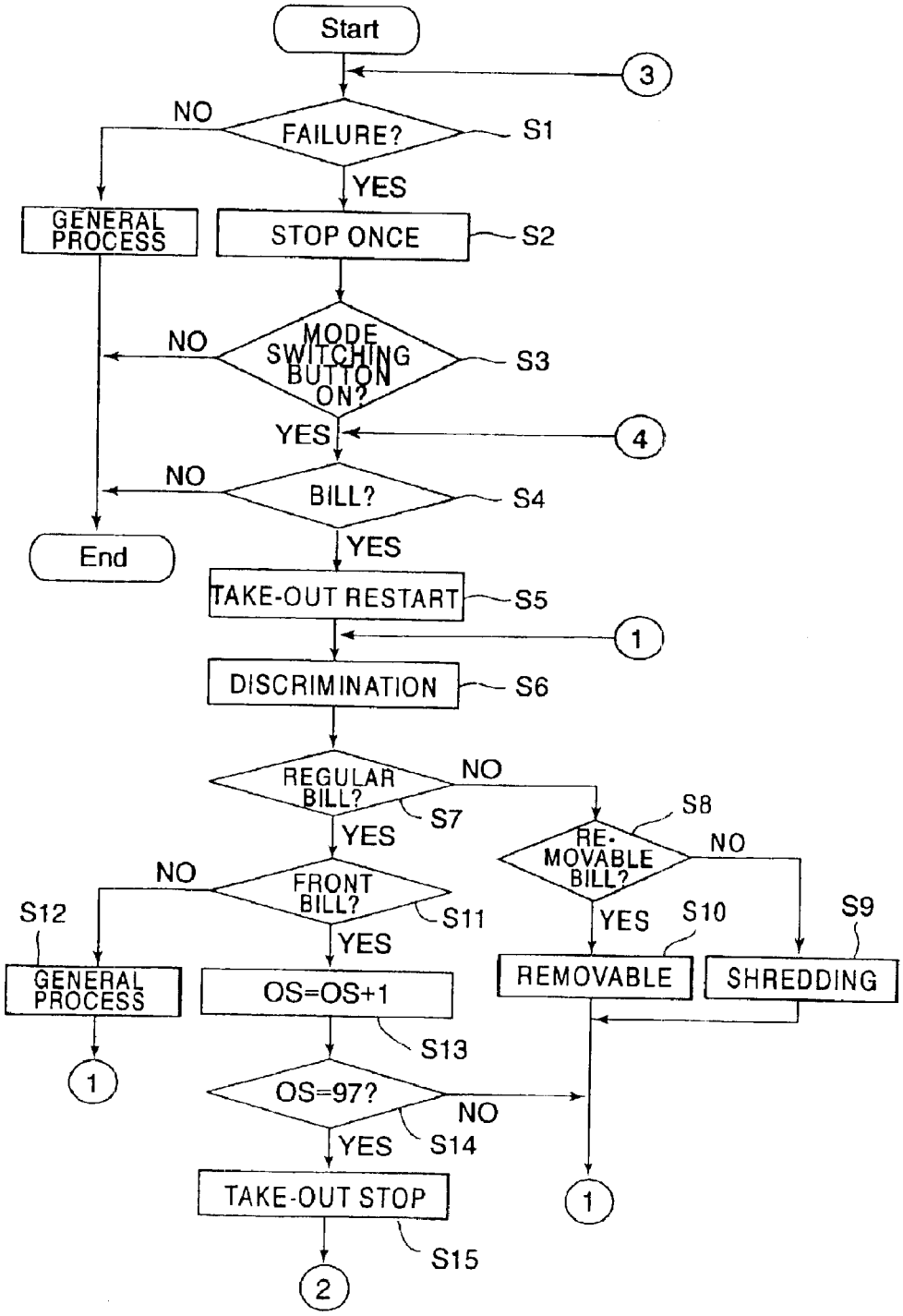
FIG. 5 is a flow chart for explaining an operation example of the processing apparatus shown in FIG. 1.
Figure 6:
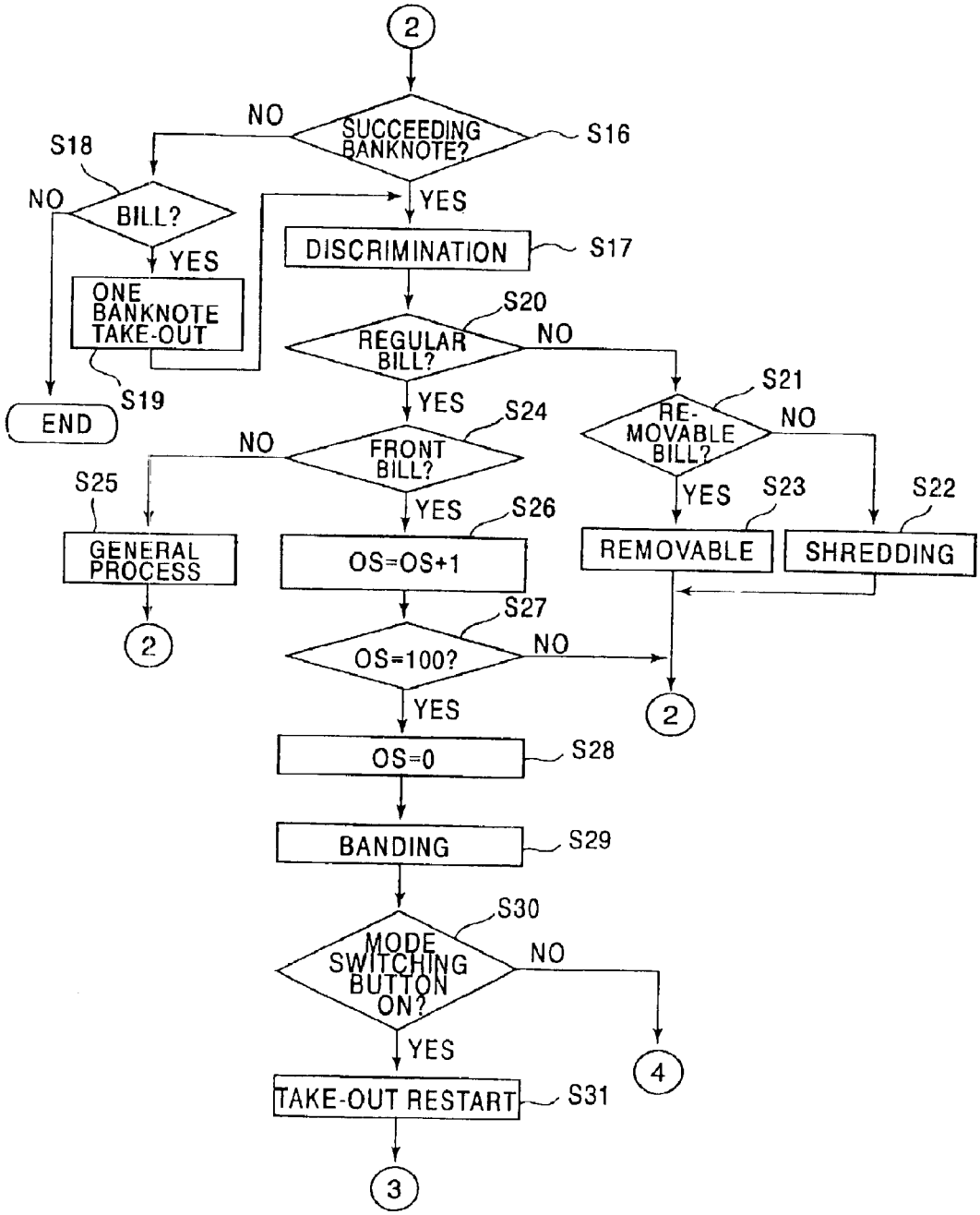
FIG. 6 is a flow chart for explaining an operation example together with FIG. 5.

Therefore, in this embodiment, even if one device cannot be used when two stacking and banding devices are assigned for each category of banknotes to be classified and stacked (that is, in a state that one stacking and banding device is assigned for each category of banknotes), the processing apparatus 1 can continue the processing without stopping the operation for many hours. Next, as an example, the processing operation when one side of the stacking and banding device 21 for classifying and stacking front bills fails will be explained by referring to the flow charts shown in FIGS. 5 and 6.

In the processing apparatus 1 mentioned above, if one side of the stacking and banding device 21 fails when the two stacking and banding devices 21 and 22 are assigned to front bills and the two stacking and banding devices 23 and 24 are assigned to back bills so as to classify and stack banknotes (YES at Step 1), the operation of the processing apparatus 1 is stopped once (Step 2). When the mode switching button 62 for switching the operation mode of the processing apparatus 1 is pressed in this state by an operator (YES at Step 3), the processing operation relating to this embodiment is started.

In the processing operation relating to this embodiment, under the condition that there are banknotes in the receiving portion 11 (YES at Step 4), the take-out roller 12 rotates and the banknotes takeout operation is re-started (Step 5). Taken-out banknotes pass the detector 13, and the characteristics thereof are detected, and "regular and defective" and "front and back" are discriminated (Step 6).

As a result of discrimination at Step 6, banknotes which are discriminated as not regular bills (NO at Step 7) and as not removable bills (NO at Step 8), that is, defective bills are sent and shredded by the shredder 30 and lose validity (Step 9). Further, as a result of discrimination, banknotes which are discriminated as not regular bills (NO at Step 7) but as removable bills (YES at Step 8) are removed into the reject box 14 (Step 10).

Further, banknotes which are discriminated at Step 6 as regular bills (YES at Step 7) and as back bills (NO at Step 11) are conveyed to either of the two stacking and banking devices 23 and 24 and processed as usual (Step 12).

On the other hand, banknotes which are discriminated at Step 6 as regular bills (YES at Step 7) and as front bills (YES at Step 11) are conveyed to the stacking and banding device 22, counted by the stacking counter 20*b*, and stacked in the stacker 28 of the stacking and banding device 22. At this time, at the point of time when the banknotes pass the detector 13, that is, at the point of time when the classification destination of the banknotes is decided (in this case, the stacking and banding device 22), the number of processed front bills is counted up by 1 by a counter not shown in the drawing (Step 13) and whether the number of processed front bills reaches 97 or not is judged (Step 14). And, until the number of processed front bills reaches 97, the processes from Step 6 to Step 13 are repeated.

When it is judged at Step 14 that the number of processed front bills reaches 97 (YES at Step 14), at the point of time when the 97th front bill passes the detector 13, the rotation of the take-out roller 12 is stopped and the banknote take-out operation is stopped (Step 15). In this embodiment, when the take-out roller 12 is stopped in a state that banknotes are continuously taken out, so as to take out a maximum of 3 banknotes on the conveying path 5 form the take-out roller 12 to the exit of the detector 13, the banknote take-out speed is set. As a result, even if banknotes taken out on the conveying path 5 following the 97th front bill are all front bills classified in the same category, front bills more than 100 bills will not be stacked in the stacking portion 25 of the stacking and banding device 22.

At the point of time when the banknote take-out operation is stopped at Step 15, whether other banknotes following the 97th front bill are taken out on the conveying path 5 from the take-out roller 12 to the detector 13 or not is judged (Step 16). At this time, when succeeding banknotes are taken out (YES at Step 16), the succeeding banknotes sequentially pass the detector 13 and are discriminated (Step 17).

On the other hand, as a result of judgment at Step 16, when the succeeding banknotes are not taken out on the conveying path 5 (NO at Step 16), under the condition that there are banknotes in the receiving portion 11 (YES at Step 18), the take-out roller 12 makes only one revolution and only one banknote is taken out on the conveying path 5 (Step 19). Banknotes taken out on the conveying path 5 in this way pass the detector 13 and are discriminated (Step 17).

As a result of discrimination at Step 17, banknotes which are judged as not regular bills (NO at Step 20) and as not removable bills (NO at Step 21), that is, defective bills are sent and shredded by the shredder 30 and lose validity (Step 22). Further, as a result of discrimination, banknotes which are judged as not regular bills (NO at Step 20) but as removable bills (YES at Step 21) are removed into the reject box 14 (Step 23).

Further, as a result of discrimination at Step 17, banknotes which are judged as regular bills (YES at Step 20) and as back bills (NO at Step 24) are conveyed to either of the two stacking and banking devices 23 and 24 and processed as usual (Step 25).

On the other hand, as a result of discrimination at Step 17, banknotes which are judged as regular bills (YES at Step 20) and as front bills (YES at Step 24) are conveyed to the stacking and banking device 22, counted by the stacking counter 20*b*, and stacked in the stacker 28 of the stacking and banking device 22. At this time, at the point of time when the front bills pass the detector 13, that is, at the point of time when the classification destination of the front bills (in this case, the stacking and banding device 22) is decided, the number of processed front bills is counted up by 1 by a counter not shown in the drawing (Step 26) and whether the number of processed front bills reaches 100 or not is judged (Step 27).

The processes at Steps 16 to 26 mentioned above are repeated and when it is judged at Step 27 that the number of processed front bills reaches 100 (YES at Step 27), a counter for counting the number of processed front bills which is not shown in the drawing is reset (Step 28) and the 100 front bills are banded (Step 29). At this time, the stacker 28 of the stacking and banding device 22 stacking the 100 front bills moves to the banding unit 26 and transfers the 100 front bills to the banding unit 26. The empty stacker 28 transferring the banknotes returns to the predetermined stacking position of the stacking portion 25. On the other hand, the banding unit 26 supplies a paper band to the 100 front bills received from the stacking portion 25, bands the front bills with the paper band, and stores the bundle of the banded banknotes in the storage unit 29.

And, after the banding process at Step 29, under the condition that the stacker 28 of the stacking and banding device 22 returns to the predetermined stacking position, the succeeding stacking operation is enabled. In this timing, the repair of the broken-down stacking and banding device 21 is completed and whether the predetermined mode switching button 62 of the operation panel 6 is pressed by an operator or not is judged (Step 30). At this time, when the mode switching button 62 is pressed (YES at Step 30), the take-out roller 12 rotates, and the banknote take-out operation is restarted (Step 31), and the processing is returned to Step 1. Further, when the mode switching button 62 is not pressed at Step 30 (NO at Step 30), it is assumed that the stacking and banding device 21 is not repaired and the processing is returned to Step 4.

As mentioned above, according to this embodiment, even if one device is made unusable for some reason when the two stacking and banding devices are assigned to one kind of banknotes, the processing can be continued without stopping the operation of the whole banknote processing apparatus 1 and the operation rate of the apparatus can be increased. Further, at this time, the conventional operation for removing banknotes which cannot be stacked into the reject box becomes unnecessary, so that the labor for re-supplying banknotes removed once is saved and the operation burden imposed on an operator can be lightened.

Figure 7:
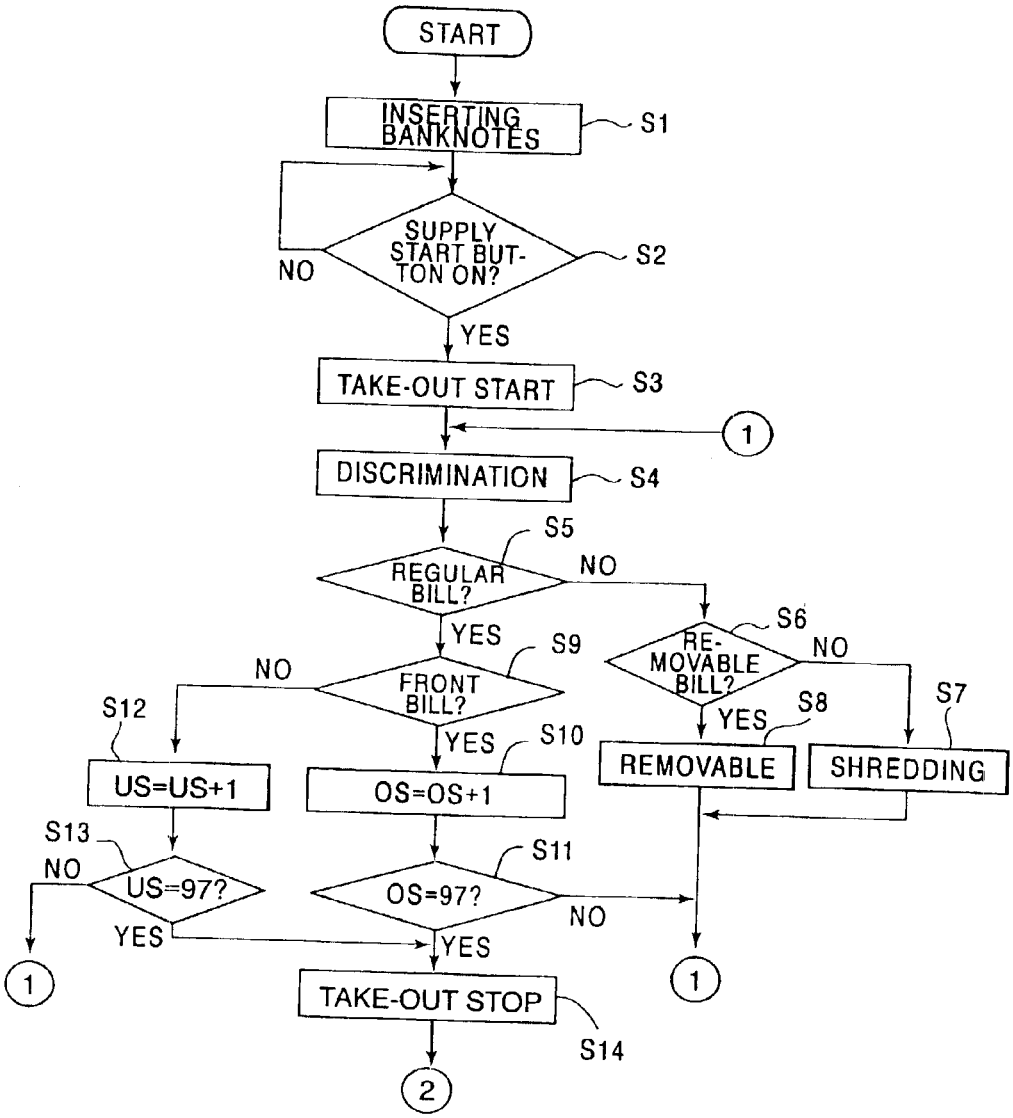
FIG. 7 is a flow chart for explaining the first operation example of the processing apparatus shown in FIG. 1.
Figure 8:
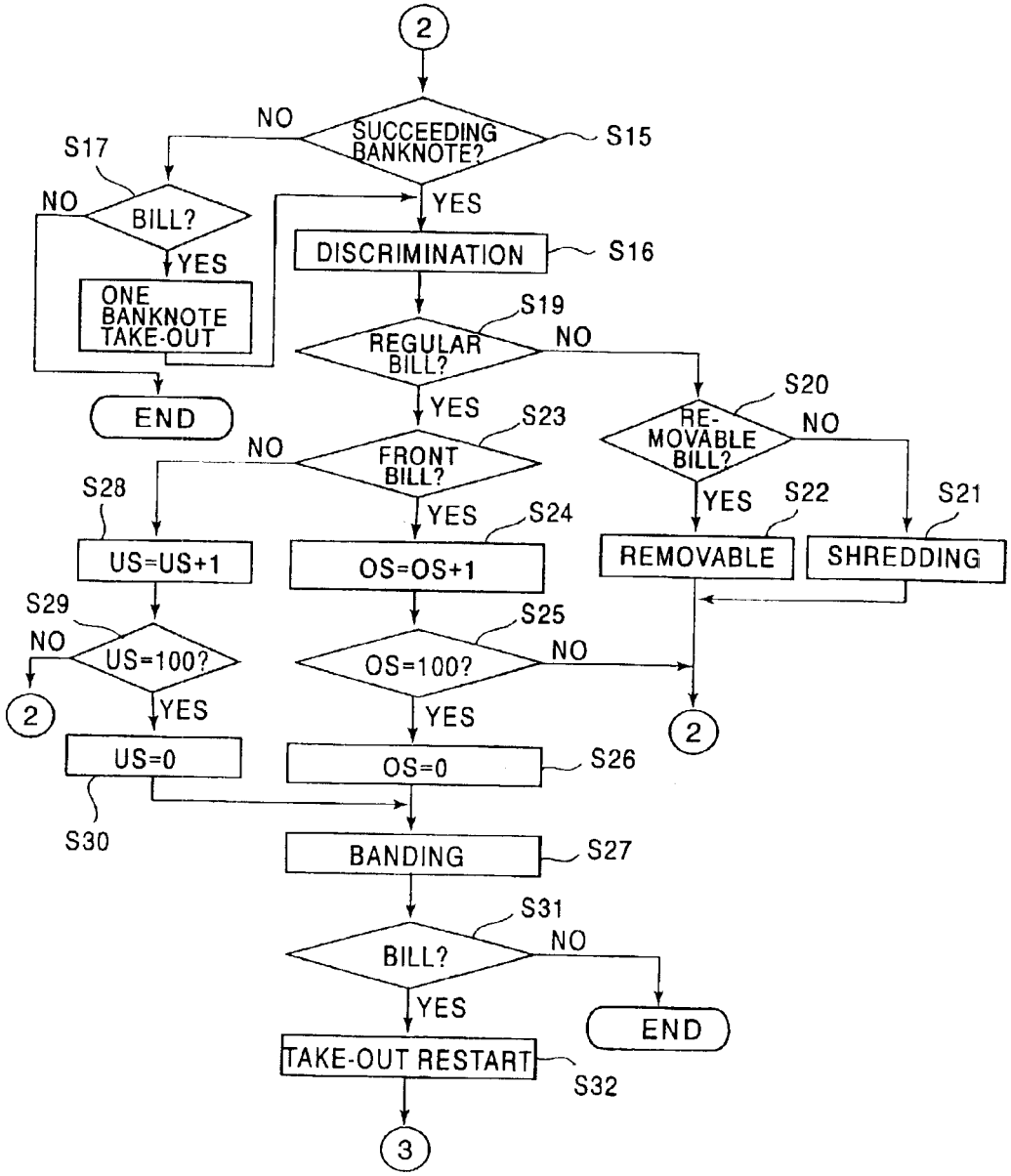
FIG. 8 is a flow chart for explaining the first operation example together with FIG. 7.

Next, the first operation example of the processing apparatus 1 mentioned above will be explained by referring to the flow charts shown in FIGS. 7 and 8. In this case, the processing operation when the stacker and banding unit 3 at the center of the processing apparatus 1 is removed, and one side of the stacking and banding device 23 is assigned for front bills, and the other side of the stacking and banding device 24 is assigned for back bills will be explained.

Firstly, a plurality of banknotes to be processed are inserted into the receiving portion 11 by an operator (Step 1). And, under the condition that the supply start button 61 of the operation panel 6 is pressed by the operator (YES at Step 2), the take-out roller 12 rotates and the banknote take-out operation starts (Step 3).

Taken-out banknotes are conveyed on the conveying path 5 and sequentially pass the detector 13 and here, the characteristics of banknotes are detected and the money kind of banknotes, truth and falsehood, the directions concerning "front and back" and "top and bottom", and regular and defective are discriminated (Step 4).

As a result of discrimination at Step 4, banknotes which are judged as not regular bills (NO at Step 5) and as not removable bills (NO at Step 6), that is, defective bills are sent and shredded by the shredder 30 and lose validity (Step 7). Further, as a result of discrimination, banknotes which are judged as not regular bills (NO at Step 5) but as removable bills (YES at Step 6) are removed into the reject box 14 (Step 8).

Further, banknotes which are judged at Step 4 as regular bills (YES at Step 5) and as front bills (YES at Step 9) are conveyed to the stacking and banding device 23 on the right in the drawing among the two stacking and banking devices 23 and 24 and stacked in the stacker 28 of the stacking portion 25. At this time, the number of stacked front bills is counted by the stacking counter 20*c* immediately before the stacking portion 25.

Further, at this time, at the point of time when the front bills pass the detector 13, that is, at the point of time when the classification destination of the front bills (in this case, the stacking and banding device 23) is decided, the number of processed front bills is counted by a counter not shown in the drawing (Step 10). And, whether the number of processed front bills counted at Step 10 reaches 97 or not is judged (Step 11).

On the other hand, banknotes which are judged at Step 4 as regular bills (YES at Step 5) and as back bills (NO at Step 9) are conveyed to the stacking and banding device 24 on the left in the drawing among the two stacking and banking devices 23 and 24 and stacked in the stacker 28 of the stacking portion 25. At this time, the number of stacked back bills is counted by the stacking counter 20*d* immediately before the stacking portion 25.

Further, at this time, at the point of time when the back bills pass the detector 13, that is, at the point of time when the classification destination of the back bills (in this case, the stacking and banding device 24) is decided, the number of processed back bills is counted by a counter not shown in the drawing (Step 12). And, whether the number of processed back bills counted at Step 12 reaches 97 or not is judged (Step 13). In other words, until the number of processed front bills or back bills reaches 97 at Step 11 or 13, the banknote take-out operation is continued.

And, when it is judged at Step 11 or 13 that the number of processed front bills or back bills reaches 97 (YES at Step 11 or YES at Step 13), at the point of time when the 97th front bill or back bill (hereinafter, referred to as the 97th regular bill) passes the detector 13, the rotation of the take-out roller 12 is stopped and the banknote take-out operation is stopped (Step 14). Also in this case, only a maximum of 3 banknotes is taken out on the conveying path 5 form the take-out roller 12 to the exit of the detector 13, so that even if all the three banknotes are stacked in one side of the stacking and banding device as banknotes of the same category, more than 100 front bills or back bills will not be stacked in the stacking portion 25 of the concerned stacking and banding device.

At the point of time when the banknote take-out operation is stopped at Step 14, whether other banknotes following the 97th regular bill are taken out on the conveying path 5 from the take-out roller 12 to the detector 13 or not is judged (Step 15). At this time, when succeeding banknotes are taken out (YES at Step 15), the succeeding banknotes sequentially pass the detector 13 and are discriminated (Step 16).

On the other hand, as a result of judgment at Step 15, when the succeeding banknotes are not taken out on the conveying path 5 (NO at Step 15), under the condition that there are banknotes in the receiving portion 11 (YES at Step 17), the take-out roller 12 makes only one revolution and only one banknote is taken out on the conveying path 5 (Step 18). Banknotes taken out on the conveying path 5 in this way pass the detector 13 and are discriminated (Step 16).

As a result of discrimination at Step 16, banknotes which are judged as not regular bills (NO at Step 19) and as not removable bills (NO at Step 20), that is, defective bills are sent and shredded by the shredder 30 and lose validity (Step 21). Further, as a result of discrimination, banknotes which are judged as not regular bills (NO at Step 19) but as removable bills (YES at Step 20) are removed into the reject box 14 (Step 22).

Further, as a result of discrimination at Step 16, banknotes which are judged as regular bills (YES at Step 19) and as front bills (YES at Step 23) are conveyed to the stacking and banding device 23 on the right in the drawing among the two stacking and banking devices 23 and 24 and stacked in the stacker 28 of the stacking portion 25. At this time, the number of stacked front bills is counted by the stacking counter 20*c* immediately before the stacking portion 25.

Further, at this time, at the point of time when the front bills pass the detector 13, that is, at the point of time when the classification destination of the front bills (in this case, the stacking and banding device 23) is decided, the number of processed front bills is counted by a counter not shown in the drawing (Step 24). And, whether the number of processed front bills counted at Step 24 reaches 100 or not is judged (Step 25).

When it is judged at Step 25 that the number of processed front bills reaches 100 (YES at Step 25), a counter for counting the number of processed front bills which is not shown in the drawing is reset (Step 26) and the stacker 28 moves and transfers the 100 front bills to the banding unit 26. And, the banding unit 26 bands the 100 regular bills with a paper band and stores them in the storage unit 29 (Step 27).

On the other hand, banknotes which are judged at Step 16 as regular bills (YES at Step 19) and as back bills (NO at Step 23) are conveyed to the stacking and banding device 24 on the left in the drawing among the two stacking and banking devices 23 and 24 and stacked in the stacker 28 of the stacking portion 25. At this time, the number of stacked back bills is counted by the stacking counter 20*d* immediately before the stacking portion 25.

Further, at this time, at the point of time when the back bills pass the detector 13, that is, at the point of time when the classification destination of the back bills (in this case, the stacking and banding device 24) is decided, the number of processed back bills is counted by a counter not shown in the drawing (Step 28). And, whether the number of processed back bills counted at Step 28 reaches 100 or not is judged (Step 29).

When it is judged at Step 29 that the number of processed back bills reaches 100 (YES at Step 29), a counter for counting the number of processed back bills which is not shown in the drawing is reset (Step 30) and the 100 back bills are banded (Step 27).

After the banding process at Step 27, under the condition that the stacker 28 of the stacking and banding device 22 or 23 returns to a predetermined stacking position, the succeeding stacking operation is enabled. And, under the condition that banknotes inserted into the receiving portion 11 remain (YES at Step 31), the take-out roller 12 rotates, and the banknote take-out operation is restarted (Step 32), and until the banknotes are all gone or a supply stop button of the operation panel 6 which is not shown in the drawing is pressed by an operator, the banknote processing operation is continued.

According to the first operation example mentioned above, even when one stacking and banding device is assigned for each banknote kind (front and back), that is, each category, during the banding operation of 100 banknotes, the banknote take-out operation may be stopped temporarily and there is no need to remove banknotes undesirably taken out into the reject box 14, so that the operation burden imposed on an operator can be lightened. Further, there is no need to stop the apparatus in order to re-supply removed banknotes, so that the operation rate of the apparatus can be increased.

Further, as a deformation example of the aforementioned first operation example, it may be considered to classify and stack front regular bills, front reverse bills, back regular bills, and back reverse bills explained in FIG. 4 respectively in the four stacking and banding devices 21, 22, 23, and 24. Also in this case, in the same as with the first operation example, the operation rate of the apparatus can be increased and the operation burden imposed on an operator can be lightened.

Figure 9:
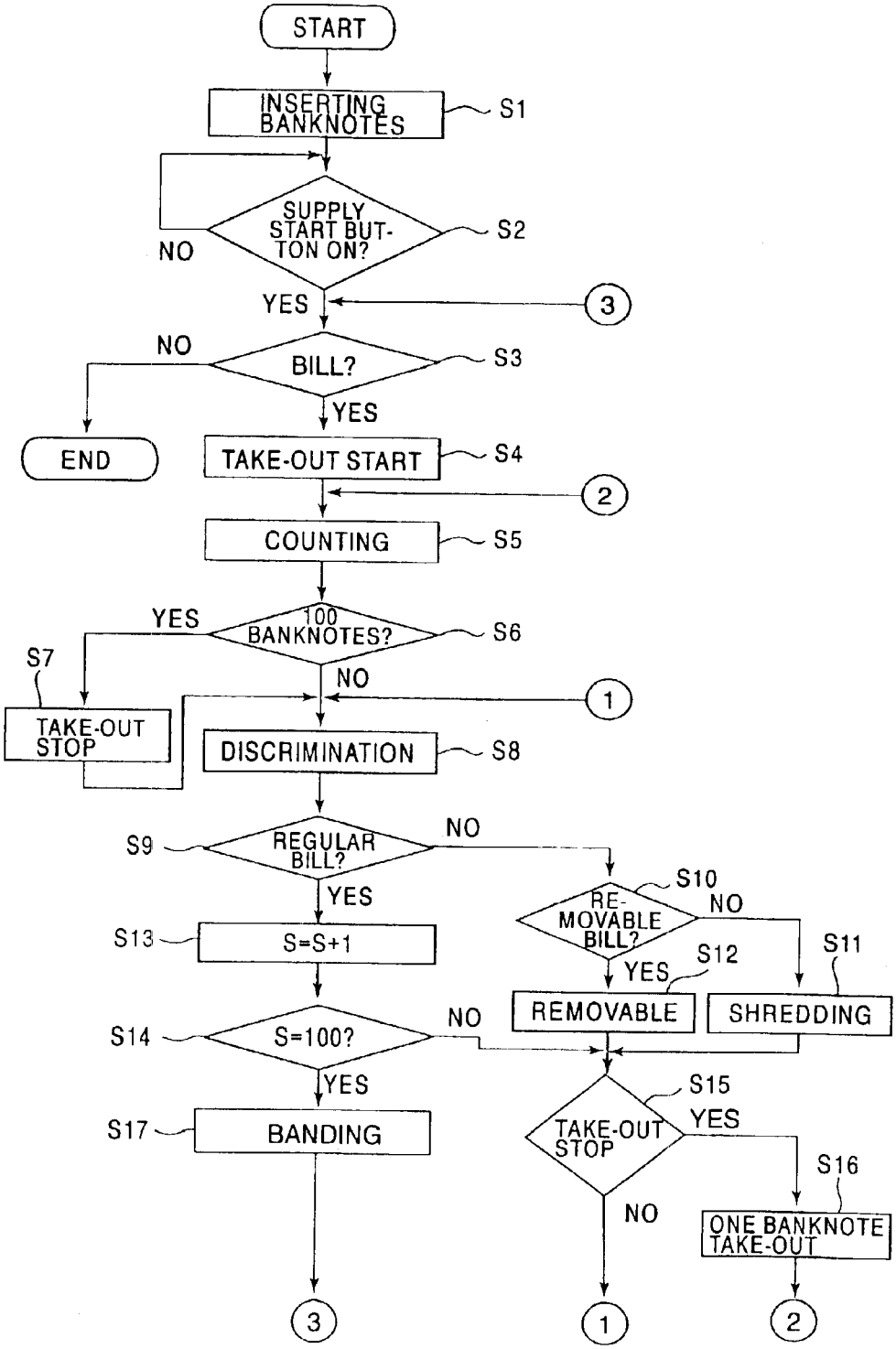
FIG. 9 is a flow chart for explaining the second operation example of the processing apparatus shown in FIG. 1.

Next, the second operation example of the processing apparatus 1 mentioned above will be explained by referring to the flow chart shown in FIG. 9. Here, an operation that a plurality of banknotes of the same money kind that the directions concerning front, back, top, and bottom are set beforehand are inserted and only each 100 regular bills are banded will be explained. Further, in this process, in the same way as with the first operation example mentioned above, the stacker and banding unit 3 at the center is removed and since the stacking and banding device 24 on the left in the drawing cannot be used for some reason, only the stacking and banding device 23 on the right in the drawing is used.

Firstly, a plurality of banknotes to be processed are inserted into the receiving portion 11 by an operator (Step 1). And, under the condition that the supply start button 61 of the operation panel 6 is pressed by the operator (YES at Step 2) and there are banknotes in the receiving portion 11 (YES at Step 3), the take-out roller 12 rotates and the banknote take-out operation starts (Step 4).

The banknotes taken out by the take-out roller 12 on the conveying path 5 pass the sensor 7 immediately behind the take-out roller 12, thus the number of taken-out banknotes is counted (Step 5). At this time, whether the number of taken-out banknotes reaches 100 or not is judged (Step 6) and at the point of time when the number reaches 100 (YES at Step 6), the take-out roller 12 is stopped and the banknote take-out operation is stopped (Step 7).

Meanwhile, banknotes passing the sensor are conveyed on the conveying path 5 and sequentially pass the detector 13 and here, the characteristics of the banknotes are detected and the money kind of banknotes, truth and falsehood, the directions concerning "front and back" and "top and bottom", and regular and defective are discriminated (Step 8).

As a result of discrimination at Step 8, banknotes which are judged as not regular bills (NO at Step 9) and as not removable bills (NO at Step 10), that is, defective bills are sent and shredded by the shredder 30 and lose validity (Step 11). Further, as a result of discrimination, banknotes which are judged as not regular bills (NO at Step 9) but as removable bills (YES at Step 10) are removed into the reject box 14 (Step 12).

Further, banknotes which are judged at Step 9 as regular bills (YES at Step 9) are conveyed to the only one stacking and banding device 23 and stacked in the stacker 28 of the stacking portion 25. At this time, the number of stacked regular bills is counted by the stacking counter 20*c* immediately before the stacking portion 25. Further, the direction of every stacked regular bill is arranged properly. And, whether the number of processed regular bills counted at Step 13 reaches 100 or not is judged (Step 14).

When it is judged at Step 14 that the number does not reach 100 (NO at Step 14), under the condition that the banknote take-out operation is not stopped at Step 7 (NO at Step 15), the processing returns to Step 8 and the banknote classifying and stacking operation is continued. Further, when the banknote take-out operation is stopped at Step 7 (YES at Step 15), the take-out roller 12 makes only one revolution, and only one banknote is taken out (Step 16), and the processing is returned to Step 5.

On the other hand, when it is judged at Step 14 that 100 regular bills are stacked in the stacker 28 (YES at Step 14), the 100 regular bills are transferred and banded by the banding unit 26 (Step 17) and the processing is returned to Step 3.

When it is expected that almost all inserted banknotes are conveyed to the stacking and banding device 23 as regular bills like the second operation example mentioned above, at the point of time when 100 banknotes are detected by the sensor 7 immediately behind the take-out roller 12, even if the banknote take-out operation is stopped once, in many cases, 100 regular bills are stacked in the stacking and banding device 23 for each stop process. Therefore, only when the number of regular bills stacked in the stacking and banding device 23 is less than 100, it is acceptable to rotate the take-out roller 12 and take out one banknote and compared with the aforementioned first operation example, the apparatus stop time during the banding operation can be shortened. By doing this, the operation rate of the apparatus can be increased more.

Further, the present invention is not limited to the aforementioned embodiment and it can be deformed variously within the range of the present invention. For example, in the aforementioned embodiment, mostly a case that the stacking and banding device fails and cannot be used is explained. However, the present invention is not limited to it and even to a case that bands are all gone in the banding unit of the stacking and banding device, the process of this embodiment can be applied.

The number of banknotes to be banded is not limited to 100 and it may be 500 or 1000.

Further, a case that stacked banknotes are banded is explained above. However, stacked banknotes may be loaded in a cash dispenser as it is without banding.

Further, in the aforementioned embodiment, when the take-out roller 12 is stopped during continuously taking out banknotes, a case that a maximum of 3 banknotes is taken out on the conveying path 5 between the take-out roller 12 and the exit of the detector 13 is explained. However, the number of banknotes varies with the banknote take-out speed and length of the conveying path, so that for example, there is a case that 6 or 7 banknotes are taken out.

As explained above, the sheet processing apparatus of the present invention has the aforementioned constitution and operation, so that the operation burden imposed on an operator can be lightened and the operation rate can be increased.

What is claimed is:

1. A sheet processing apparatus comprising:

a receiving portion to receive a plurality of sheets to be inserted;

a take-out portion to take out sheets inserted into the receiving portion one by one on a conveying path;

a detector to detect characteristics of the sheets taken out on the conveying path by the take-out portion and discriminate a category thereof;

a stacking portion to stack a predetermined number M of sheets discriminated as a specific category by the detector; and a controller to control the take-out portion so as to stop an operation of the take-out portion at the point of time when an Nth sheet less than the predetermined number M to be stacked in the stacking portion is discriminated.

2. The sheet processing apparatus according to claim 1 further comprising:

a banding unit to receive and band the predetermined number M of sheets stacked in the stacking portion.

3. The sheet processing apparatus according to claim 1, wherein the detector discriminates a front and a back of sheets.

4. The sheet processing apparatus according to claim 3, wherein the stacking portion includes:

a first stacking portion to stack sheets discriminated as front by the detector; and a second stacking portion to stack sheets discriminated as back by the detector.

5. The sheet processing apparatus according to claim 1, wherein the controller stops the operation of the take-out portion and then even if all sheets taken out already on the conveying path are processed, when the number of sheets stacked in the stacking portion is less than M, until the number of sheets stacked in the stacking portion reaches M, the controller operates the take-out portion and controls the take-out portion so as to take out the sheets one by one.

6. The sheet processing apparatus according to claim 1, wherein at the point of time when the controller stops the take-out portion, the number of sheets taken out on the conveying path from the take-out portion to the detector is M to N at its maximum.

7. The sheet processing apparatus according to claim 2, wherein the stacking portion has a stacker to move to the banding unit when M sheets are stacked and transfer the M sheets to the banding unit and enables next stacking of sheets when the stacker returns to an original stacking position.

8. A sheet processing apparatus comprising:

a receiving portion to receive a plurality of sheets to be inserted;

a take-out portion to take out sheets inserted into the receiving portion one by one on a conveying path;

a detector to detect characteristics of the sheets taken out on the conveying path by the take-out portion and discriminate a category thereof;

a first stacking portion to stack first sheets discriminated as a first category by the detector;

a second stacking portion to stack second sheets discriminated as a second category by the detector; and a controller to control the take-out portion so as to stop an operation of the take-out portion at the point of time when an Nth first sheet less than M sheets to be stacked in the first stacker is discriminated by the detector or at the point of time when an Nth second sheet to be stacked in the second stacker is discriminated by the detector.

9. The sheet processing apparatus according to claim 8 further comprising:

a first banding unit to receive and band the M first sheets stacked in the first stacking portion; and a second banding unit to receive and band the M second sheets stacked in the second stacking portion.

10. The sheet processing apparatus according to claim 8, wherein at the point of time when the controller stops the operation of the take-out portion, the number of sheets taken out on the conveying path from the take-out portion to the detector is M to N at its maximum.

11. The sheet processing apparatus according to claim 9, wherein the first and second stacking portions have stackers for moving to corresponding banding units when M sheets are stacked and transferring the M sheets to the banding units and enable next stacking of sheets when the stackers return to original stacking positions.

* * * * *